US007050049B2

(12) United States Patent
Byun

(10) Patent No.: US 7,050,049 B2
(45) Date of Patent: May 23, 2006

(54) DISPLAY DEVICE AND METHOD OF CONTROLLING THE SAME

(75) Inventor: Ho-jin Byun, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 136 days.

(21) Appl. No.: 10/197,840

(22) Filed: Jul. 19, 2002

(65) Prior Publication Data

US 2003/0156106 A1 Aug. 21, 2003

(30) Foreign Application Priority Data

Feb. 18, 2002 (KR) ..... 2002-8452

(51) Int. Cl.
*G09G 5/06* (2006.01)

(52) U.S. Cl. ..... 345/211; 345/212; 713/310

(58) Field of Classification Search ..... 345/211–213; 348/730; 713/310, 300, 320
See application file for complete search history.

(56) References Cited

U.S. PATENT DOCUMENTS 6,006,335 A * 12/1999 Choi et al. ..... 713/310
6,115,033 A * 9/2000 Choi ..... 345/211
6,275,221 B1 * 8/2001 Song ..... 345/211
6,326,935 B1 * 12/2001 Boger ..... 345/3.2
6,404,423 B1 * 6/2002 Kivela et al. ..... 345/212
6,593,975 B1 * 7/2003 Oh ..... 348/730
6,738,055 B1 * 5/2004 Abe et al. ..... 345/211
2001/0043203 A1 * 11/2001 Iinuma ..... 345/204

FOREIGN PATENT DOCUMENTS

| | | |
|---|---|---|
| JP | 7-95495 | 4/1995 |
| JP | 9-16293 | 1/1997 |
| JP | 2000-92742 | 3/2000 |
| KR | 1998-44732 | 9/1998 |
| KR | 10-202953 | 3/1999 |
| KR | 1999-13697 | 4/1999 |

* cited by examiner

*Primary Examiner*—Regina Liang
(74) *Attorney, Agent, or Firm*—Staas & Halsey LLP

(57) ABSTRACT

A display device includes a displaying part which displays a picture based on a video signal output from a computer main body, a power supply which supplies driving power corresponding to one of a normal mode and a power saving mode, a power saving mode selection part which allows selection of the power saving mode, and a micro controller which controls the power supply to supply the driving power to the display device according to the power saving mode selected through the power saving mode selection part. Therefore, the display device can perform a power saving function by itself according to a selection by a user.

21 Claims, 4 Drawing Sheets

DISPLAY DEVICE AND METHOD OF CONTROLLING THE SAME

CROSS-REFERENCE TO RELATED APPLICATIONS

This application claims the benefit of Korean Patent Application No. 2002-8452 filed on Feb. 18, 2002, in the Korean Industrial Property Office, the disclosure of which is incorporated herein by reference.

BACKGROUND OF THE INVENTION

1. Field of the Invention

The present invention relates to a display device having a selection part which allows a user to select a power saving mode of the display device, and a method of controlling the same.

2. Description of the Related Art

In a computer system, a display device consumes most of the power that the computer system uses. Therefore, there have been proposed various methods of saving the power consumed by the display device. The display power management signaling (DPMS) standard is an international standard for display devices, and a DPMS function is recently being applied to most of the display devices.

According to the DPMS standard, a power saving function of the display device is performed according to the state of a computer main body. That is, the computer main body selectively transmits horizontal and vertical synchronous signals to the display device, and the power saving function of the display device is performed depending upon the horizontal and vertical synchronous signals output from the computer main body.

The power saving function of the display device is classified into a normal mode including a power-on state, and a power saving mode including a standby state, a suspend state, and a power-off state.

FIG. 4 shows a control block diagram of a computer system comprising a conventional display device. As shown therein, a computer main body 100 comprises a central processing unit (CPU) 103, and a video card 105 which processes data output from the CPU 103 into a video signal (Red, Green, Blue), and outputs horizontal and vertical synchronous signals to synchronize the video signal (R, G, B).

A display device 110 displays a picture based on the video signal (R, G, B) output from the computer main body 100, and comprises a signal processing part 112 which processes the video signal (R, G, B) output from the computer main body 100, and a displaying part 114 which displays the picture based on the video signal (R, G, B) processed by the signal processing part 112.

The display device 110 further comprises an AC input part 116 through which alternating current (AC) power is input, a rectifier 118 which rectifies the input AC power into direct current (DC) power, a switching transformer 120 which receives the rectified DC power, a power regulator 122 and a power output part 124 which convert and output AC power output from the switching transformer 120 into DC power, and a pulse width modulation (PWM) part 126 which transmits a pulse signal so as to control a switching operation of the switching transformer 120.

The switching transformer 120 is switched on/off in response to the pulse signal transmitted from the PWM part 126, and converts the DC power output from the rectifier 118 into AC power. The power regulator 122 converts the AC power output from the switching transformer 120 into DC power, and supplies driving powers to components of the display device 110, respectively.

A micro controller 128 controls the power regulator 122 and the PWM part 126 in response to the horizontal and vertical synchronous signals being output from the video card 105 of the computer main body 100, so as to apply a power saving mode to the display device 110.

For example, when the video card 105 outputs both the vertical and horizontal synchronous signals, the micro controller 128 transmits a normal mode signal to the power regulator 122, so as to apply electric power normally to the display device 110. When the video card 105 outputs only the horizontal synchronous signal, the micro controller 128 transmits a suspend mode signal to the power regulator 122. When the video card 105 outputs only the vertical synchronous signal, the micro controller 128 transmits a standby mode signal to the power regulator 122. When the video card 105 does not output any of the synchronous signals, the micro controller 128 controls the PWM part 126 and allows the display device 110 to be in a power-off mode state.

Thus, the power saving function of the display device 110 is performed according to the computer main body 100. Therefore, if the computer main body 100 does not have a power saving function, the display device 110 cannot perform the power saving function. Furthermore, even if the computer main body 100 has the power saving function, the display device 110 performs the power saving function after an elapse of a predetermined period of time where a user temporarily stops using the display device 110.

SUMMARY OF THE INVENTION

Accordingly, it is an object of the present invention to provide a display device having a selection part which allows a user to select a power saving mode of the display device, and a method of controlling the same.

Additional objects and advantages of the invention will be set forth in part in the description which follows and, in part, will be obvious from the description, or may be learned by practice of the invention.

To achieve the above and other objects of the present invention, there is provided a display device comprising a displaying part which displays a picture based on a video signal output from a computer main body, a power supply which supplies driving power corresponding to one of a normal mode and a power saving mode, a power saving mode selection part which allows selection of the power saving mode, and a micro controller which controls the power supply to supply the driving power to the display device according to the power saving mode selected through the power saving mode selection part.

According to an aspect of the present invention, the power saving mode selection part is an on screen display (OSD) displayed on the displaying part.

According to another aspect of the present invention, the power saving mode selection part is a selection button provided separately in an outer casing of the displaying part.

According to yet another aspect of the present invention, the power saving mode selection part includes at least one of a standby mode selection part, a suspend mode selection part, and a power-off mode selection part based on the DPMS standard, and the micro controller controls the power supply to supply the driving power corresponding to the power saving mode selected through the power saving mode selection part, wherein the power saving mode includes a standby mode, a suspend mode, and a power-off mode.

According to still another aspect of the present invention, the micro controller transmits a power saving mode signal corresponding to the power saving mode selected through the power saving mode selection part to the computer main body, so as to allow the computer main body to be in a power state of the selected power saving mode.

According to an additional aspect of the present invention, the micro controller controls the power supply to supply the driving power corresponding to the power saving mode based on whether horizontal and vertical synchronous signals are output from the computer main body.

To achieve the above and other objects of the present invention, there is provided a method of controlling a display device having a displaying part which displays a picture based on a video signal output from a computer main body, and a power supply which supplies driving power corresponding to one of a normal mode and a power saving mode, the method comprising providing a power saving mode selection part for selecting the power saving mode and controlling the display device to be in a power saving mode state according to the power saving mode selected through the power saving mode selection part.

The method further comprises checking whether the computer main body outputs a horizontal synchronous signal and a vertical synchronous signal and allowing the display device to be in the power saving mode state according to whether each of the horizontal synchronous signal and the vertical synchronous signal is output.

The power saving mode state includes a standby mode state, a suspend mode state, and a power-off mode state based on the DMPS standard.

The method further comprises allowing the computer main body to be in the power saving mode state by transmitting a power saving mode signal corresponding to the power saving mode selected through the power saving mode selection part to the computer main body.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
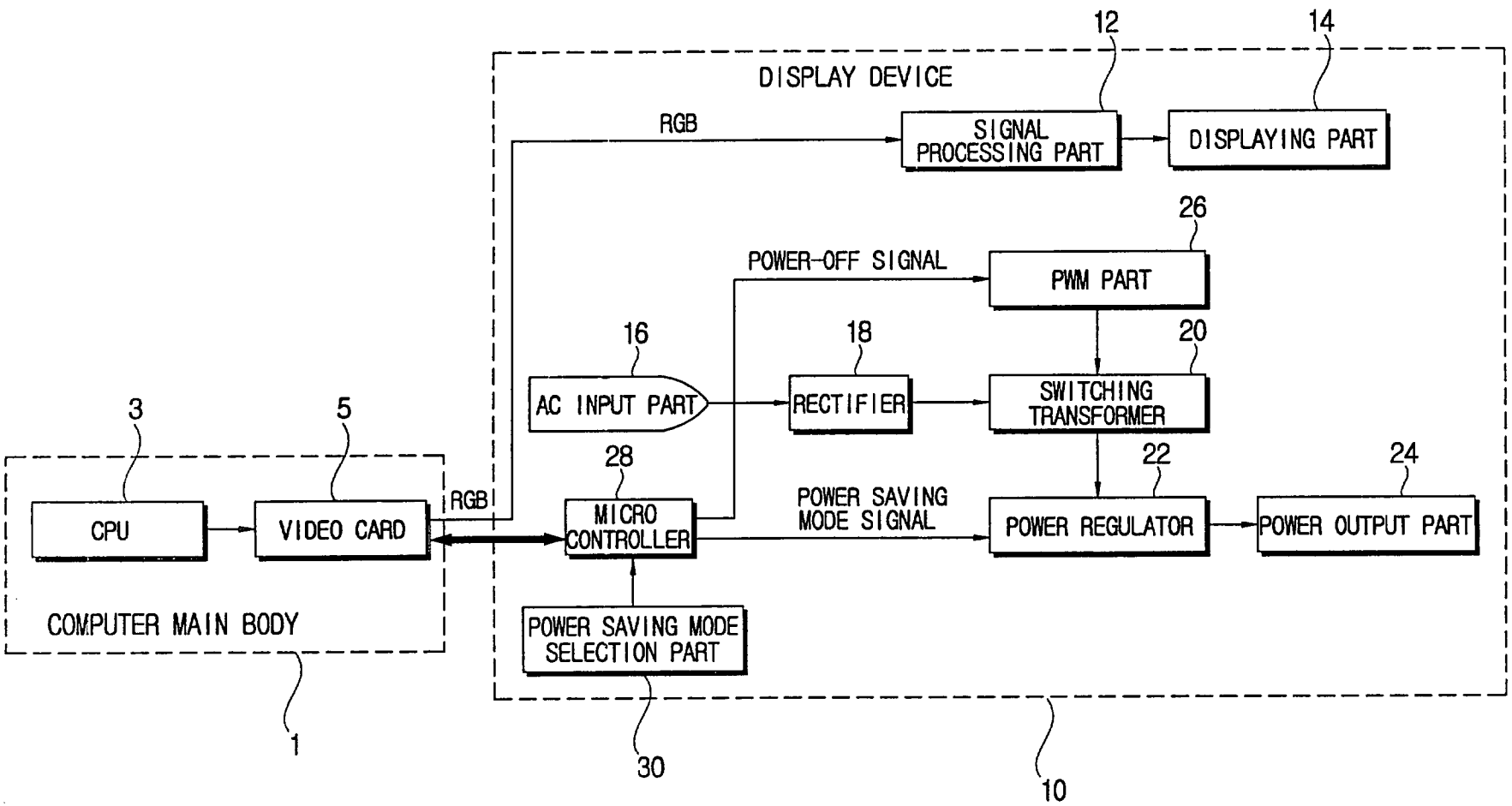
FIG. 1 is a control block diagram of a computer system comprising a display device according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 shows a control block diagram of a computer system comprising a display device according to an embodiment of the present invention. A main body 1 of the computer system comprises a central processing unit (CPU) 3, and a video card 5 which processes data output from the CPU 3 into a video signal (Red, Green, Blue), and outputs horizontal and vertical synchronous signals to synchronize the video signal.

A display device 10 according to the present invention comprises a signal processing part 12 which processes the video signal (R, G, B) output from the video card 5, and a displaying part 14 which displays a picture based on the video signal (R, G, B) processed by the signal processing part 12, so as to display the picture based on the video signal (R, G, B) output from the main body 1.

The display device 10 further comprises an AC input part 16 through which commercial alternating current (AC) power is input, a rectifier 18 which rectifies the input commercial AC power into direct current (DC) power, a switching transformer 20 which receives and converts the rectified DC power into the AC power, a power regulator 22 and a power output part 24 which convert and output the AC power output from the switching transformer 20 into the DC power, and a pulse width modulation (PWM) part 26 which transmits a pulse signal so as to control a switching operation of the switching transformer 20.

The switching transformer 20 is switched on/off in response to the pulse signal transmitted from the PWM part 26, and converts the DC power output from the rectifier 18 into the AC power. The power regulator 22 converts the AC power output from the switching transformer 20 into the DC power, and supplies driving powers to components of the display device 10.

The display device 10 according to the present invention further comprises a power saving mode selection part 30 which allows a user to select a power saving function, and a micro controller 28 which controls the power regulator 22 and the PWM part 26 according to the power saving function selected by the user, and transmits a power saving mode signal to the main body 1.

Figure 2:
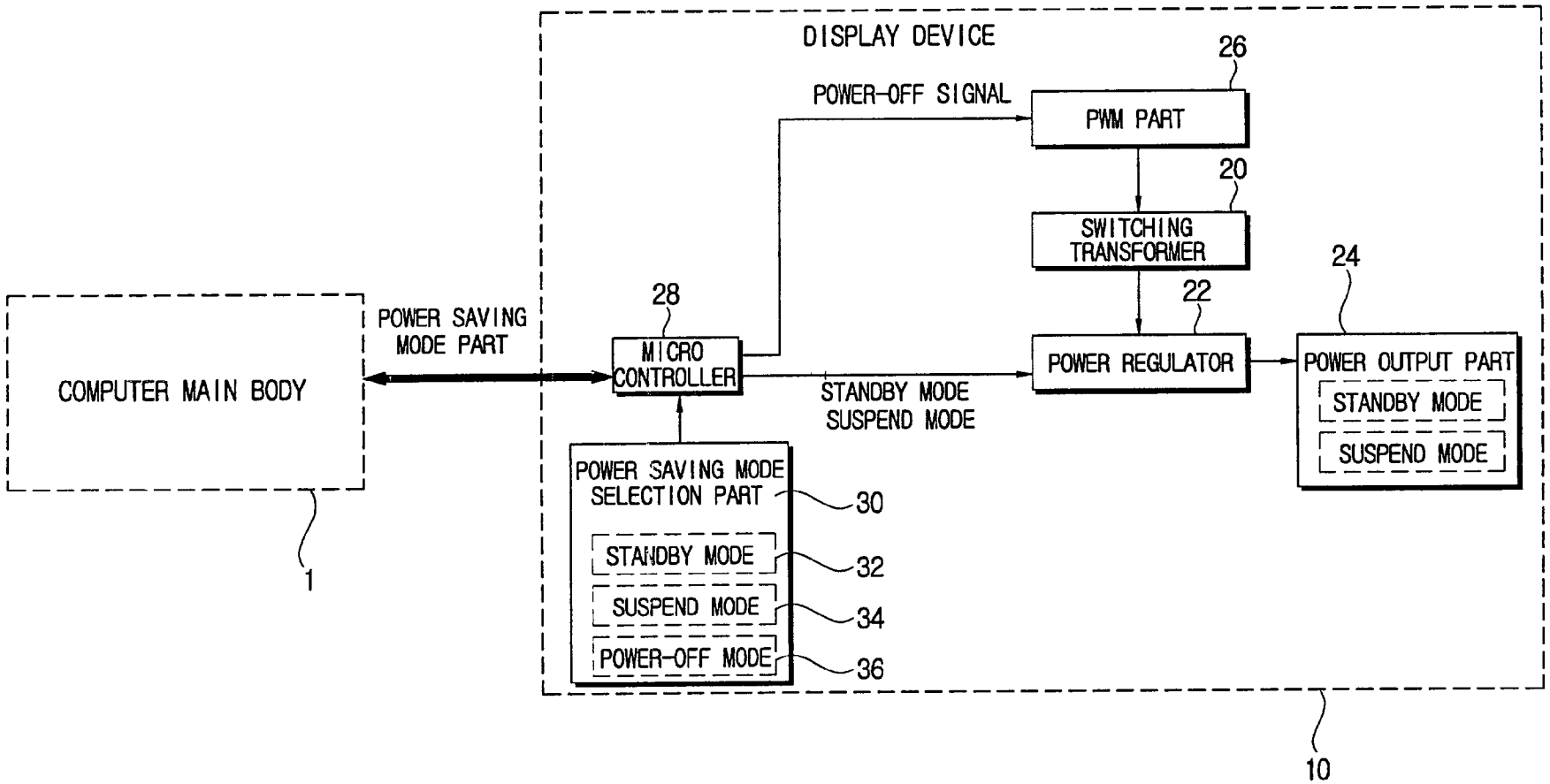
FIG. 2 is a control block diagram illustrating a power saving function performed by a micro controller of the display device of FIG. 1.

FIG. 2 shows a control block diagram which illustrates a power saving function by the micro controller 28 of the display device 10.

The power saving mode selection part 30 is employed to select the power saving function of the display device 10, directly, according to the user, and can be, for example, an on screen display (OSD) through which the user can transmit a selection signal to the micro controller 28, or a selection button which is separately provided in a main casing (not shown) of the display device 10. As shown in FIG. 2, the power saving mode selection part 30 includes a plurality of selection menus, such as a standby mode selection part 32, a suspend mode selection part 34 and a power-off mode selection part 36, so as to have the display device 10 be in a power saving mode state desired by the user.

The micro controller 28 transmits a power saving mode signal to the power regulator 22 and the PWM part 26 according to the power saving function selected by the user through the power saving mode selection part 30, so as to allow the display device 10 to be in the power saving mode state desired by the user.

For example, when a user selects the standby mode selection part 32 or the suspend mode selection part 34 through the power saving mode selection part 30, the micro controller 28 transmits a standby mode signal or a suspend mode signal to the power regulator 22. Then, the power regulator 22 outputs a voltage corresponding to a power saving mode, such as a standby mode or a suspend mode, through the power output part 24 in response to the standby mode signal or the suspend mode signal transmitted from the micro controller 28, thereby allowing the display device 10 to be in a standby mode state or a suspend mode state.

Furthermore, when a user selects the power-off mode selection part 36 through the power saving mode selection part 30, the micro controller 28 transmits a power-off signal to the PWM part 26, thereby allowing the display device 10 to be in a power-off mode state.

In the display device 10 according to the present invention, the micro controller 28 can also perform the power saving function according to the horizontal and vertical synchronous signals output from the video card 5 of the main body 1 aside from the power saving mode signal input from the power saving mode selection part 30.

Figure 3:
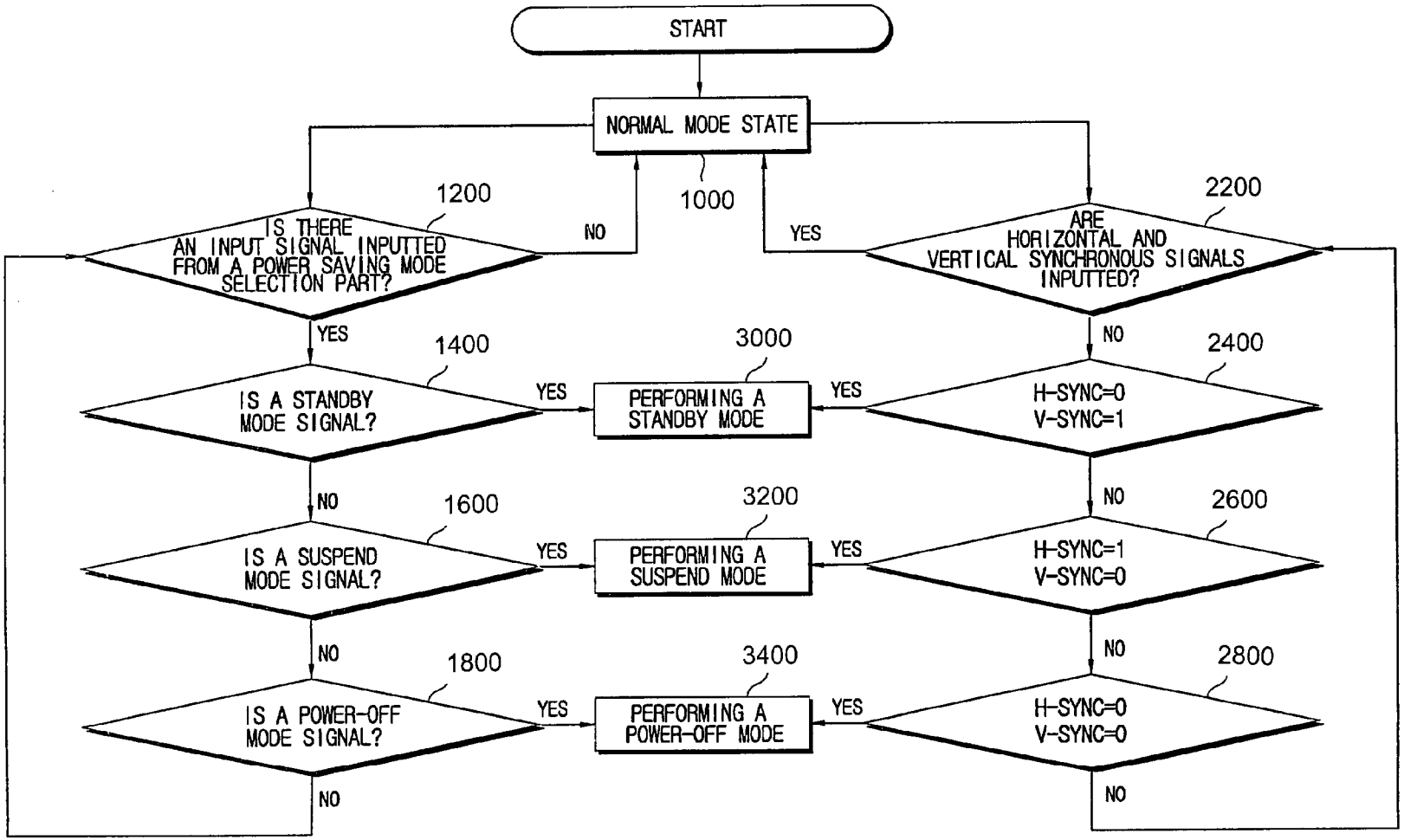
FIG. 3 is a flow chart illustrating a method of performing the power saving function to the display device of FIG. 1.
Figure 4:
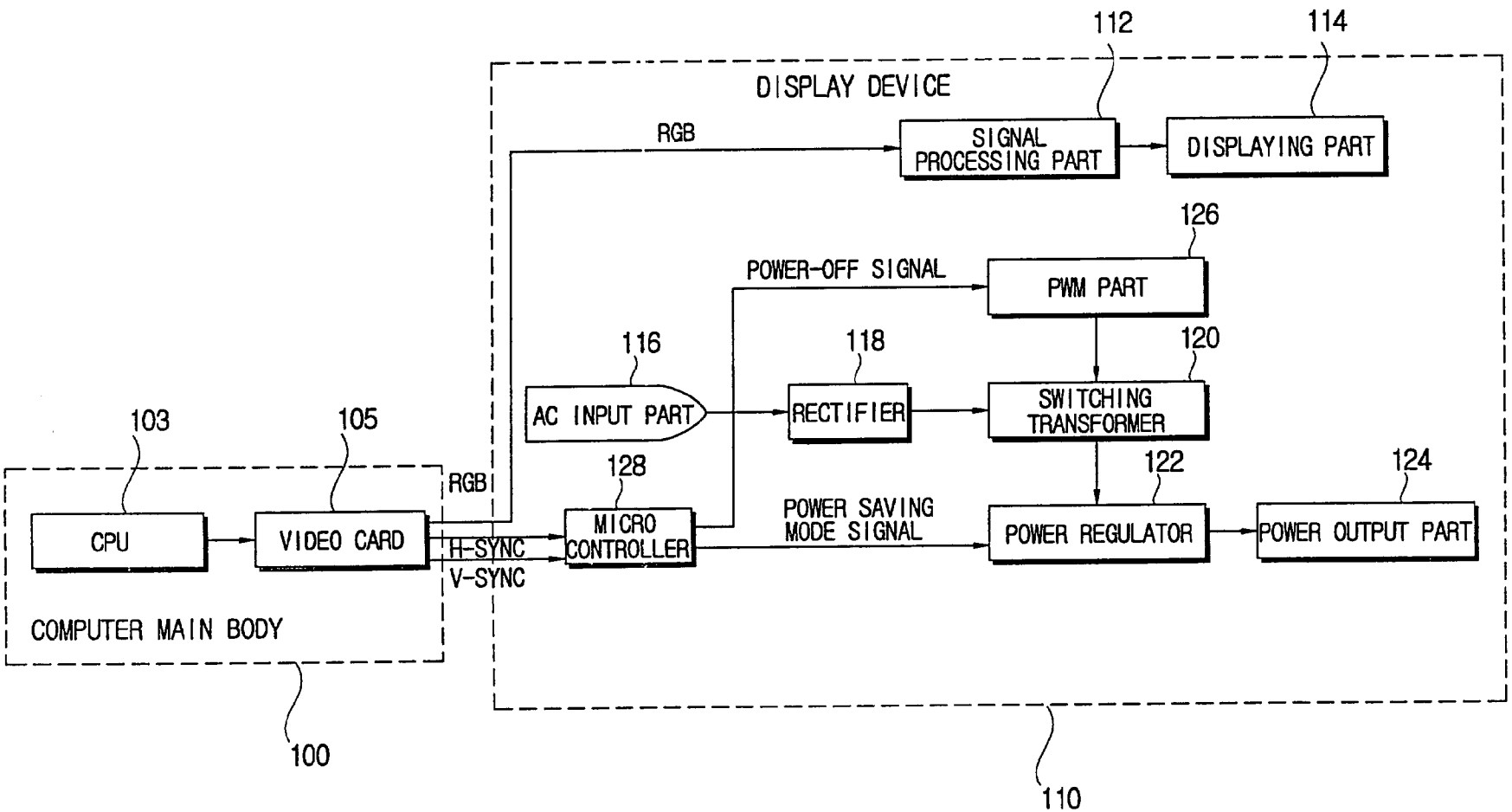
FIG. 4 (PRIOR ART)
FIG. 4 is a control block diagram of a computer system comprising a conventional display device.

FIG. 3 shows a method of controlling the display device as shown in FIGS. 1 and 2. As shown in FIG. 3, while the display device 10 is in a normal operation state (operation 1000), the micro controller 28 simultaneously checks whether the power saving mode signal is input from the power saving mode selection part 30 (operation 1200), and whether both the horizontal and vertical signals are input from the video card 5 (operation 2200).

Where the power saving mode signal is input from the power saving mode selection part 30, the micro controller 28 determines whether the power saving mode signal is the standby mode signal (operation 1400). Where the power saving mode signal is determined as the standby mode signal, the micro controller 28 controls the display device 10 to be in the standby mode state (operation 3000).

Where the power saving mode signal is not determined as the standby mode signal, the micro controller 28 determines whether the power saving mode signal is the suspend mode signal (operation 1600). Where the power saving mode signal is determined as the suspend mode signal, the micro controller 28 controls the display device 10 to be in the suspend mode state (operation 3200).

Where the power saving mode signal is not determined as the suspend mode signal, the micro controller 28 determines whether the power saving mode signal is the power-off mode signal (operation 1800). Where the power saving mode signal is determined as the power-off mode signal, the micro controller 28 controls the display device 10 to be in the power-off mode state (operation 3400).

However, where the power saving mode signal is not determined as one of the standby, suspend, and power-off mode signals, the micro controller 28 checks again whether the power saving mode signal is input from the power saving mode selection part 30 (operation 1200).

On the other hand, where the micro controller 28 determines that both the horizontal and vertical synchronous signals are not output from the video card 5, that is, when only the vertical synchronous signal is output from the video card 5 (operation 2400), the micro controller 28 controls the display device 10 to be in the standby mode state (operation 3000).

Where the micro controller 28 determines that only the horizontal synchronous signal is outputted from the video card 5 (operation 2600), the micro controller 28 controls the display device 10 to be in the suspend mode state (operation 3200).

Where the micro controller 28 determines that both the horizontal synchronous signal and the vertical synchronous signal are not output from the video card 5 (operation 2800), the micro controller 28 controls the display device 10 to be in the power-off mode state (operation 3400).

In the display device 10 according to the present invention, the micro controller 28 may perform the power saving function of the display device 10 not only by processing the power saving mode signal output from the power saving mode selection part 30 and the synchronous signal(s) output from the video card 5, but also through an other power saving function supported in the main body 1.

Additionally, in the display device 10 according to the present invention, the micro controller 28 can transmit the power saving mode signal to the main body 1, as selected by a user (the power saving function), through the power saving mode selection part 30. Therefore, the main body 1 can also be controlled to be in the power saving mode state according to the power saving mode signal transmitted from the micro controller 28. This control is achieved by providing an interface such as an inter integrated circuit ($I^2C$) bus and a display data channel (DDC) between the display device 10 and the main body 1.

With the above configuration, the micro controller 28 controls the power regulator 22 and supplies electric power corresponding to the power saving mode selected by a user through the OSD or the selection button, thereby allowing the display device 10 to be in the power saving mode state. Furthermore, the power saving mode signal selected by the user is transmitted to the main body 1, thereby allowing the main body 1 to be in the power saving mode state.

According to the present invention, there is provided a power saving mode selection part which allows selection of a plurality of power saving modes of a display device, and a micro controller which controls driving power supplied to the display device according to a power saving mode signal of the power saving mode selection part, so as to allow the display device to perform the power saving function by itself according to a selection of a user. The display device according to the present invention can also communicate with a computer main body, so as to control the computer main body to be in a power saving mode state by transmitting the power saving mode signal selected by the user to the main body.

It is understood that a system which uses the present invention may also include permanent or removable storage, such as magnetic and optical discs, RAM, ROM, etc., on which the operation and data structures of the present invention can be stored and distributed. The operations can also be distributed via, for example, downloading over a network such as the Internet.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display device receiving a video signal output from a computer main body, comprising:

a displaying part which displays a picture based on the video signal output from the computer main body;

a power supply which supplies driving power corresponding to one of a normal mode and a power saving mode of the display device;

a power saving mode selection part which allows a user to select the power saving mode from among a plurality of power saving modes presented to the user at the same time; and a micro controller which controls the power supply to supply the driving power to the display device according to the power saving mode selected through the power saving mode selection part, wherein the micro controller transmits a power saving mode signal corresponding to the power saving mode selected through the power saving mode selection part to the computer main body, so as to cause the computer main body to be in the selected power saving mode.

2. The display device according to claim 1, wherein the power saving mode selection part comprises at least an on screen display (OSD) displayed on the displaying part.

3. The display device according to claim 1, wherein the power saving mode selection part comprises at least a selection button provided separately in an outer casing of the displaying part.

4. The display device according to claim 1, wherein:

the power saving mode selection part includes at least one of a standby mode selection part, a suspend mode selection part, and a power-off mode selection part based on a display power management signaling (DPMS) standard, and the micro controller controls the power supply to supply the driving power corresponding to the power saving mode selected through the power saving mode selection part, wherein the power saving mode includes a standby mode, a suspend mode, and a power-off mode.

5. The display device according to claim 1, wherein the micro controller controls the power supply to supply the driving power corresponding to the power saving mode based on whether horizontal and vertical synchronous signals of the video signal are output from the computer main body.

6. The display device according to claim 5, wherein the micro controller simultaneously determines whether the power saving mode is input through the power saving mode selection part and whether the horizontal and vertical synchronous signals are output from the computer main body.

7. The display device according to claim 1, further comprising:

a signal processing part which processes the video signal;

an alternating current (AC) input part which transmits AC power to the display device;

a rectifier which rectifies the AC power into direct current (DC) power;

a switching transformer which receives and converts the rectified to DC power into the AC power;

a power regulator which converts the AC power output from the switching transformer into the DC power and supplies driving powers to components of the display device;

a power output part which outputs the DC power; and a pulse width modulation (PWM) part which transmits a pulse signal so as to control a switching operation of the switching transformer.

8. The display device according to claim 1, wherein the power saving mode selection part allows a user to directly select a desired power saving mode of the display device.

9. The display device according to claim 1, further comprising one of an inter integrated circuit ($I^2C$) bus and a display data channel (DDC) which provides an interface between the display device and the computer main body.

10. A method of controlling a display device having a displaying part which displays a picture based on a video signal output from a computer main body, and a power supply which supplies driving power corresponding to one of a normal mode and a power saving mode of the display device, the method comprising:

providing a power saving mode selection part allowing a user to select the power saving mode from among a plurality of power saving modes presented to the user at the same time;

controlling the display device to be in a power saving mode state according to the power saving mode selected through the power saving mode selection part; and allowing the computer main body to be in the power saving mode state by transmitting a power saving mode signal corresponding to the power saving mode selected through the power saving mode selection part to the computer main body.

11. The method according to claim 10, further comprising:

checking whether the computer main body outputs a horizontal synchronous signal and a vertical synchronous signal; and allowing the display device to be in the power saving mode state according to whether each of the horizontal synchronous signal and the vertical synchronous signal is output.

12. The method according to claim 11, wherein the allowing the display device to be in the power saving mode state according to whether each of the horizontal and vertical synchronous signals is output comprises:

controlling the display device to be in a standby mode state in response to the vertical synchronous signal being output;

controlling the display device to be in a suspend mode state in response to the horizontal synchronous signal being output; and controlling the display device to be in a power-off mode state in response to both the horizontal and vertical synchronous signals not being output.

13. The method according to claim 10, wherein the power saving mode state includes a standby mode state, a suspend mode state, and a power-off mode state based on a display power management signaling (DMPS) standard.

14. A display device for displaying an image output from a computer main body, comprising:

a power saving mode selection part which allows a user to select a desired power saving mode of the display device from among a plurality of power saving modes presented to the user at the same time, so as to have the display device and/or the computer main body be in the desired power saving mode selected by the user; and a micro controller which controls a driving power to the display device according to the power saving mode selected by the user through the power saving mode selection part, wherein the plurality of power saving modes includes a standby mode, a suspend mode and a power-off mode, and wherein the micro controller transmits a power saving mode signal corresponding to the power saving mode selected through the power saving mode selection part to the computer main body, so as to cause the computer main body to be in the selected power saving mode.

15. A computer system comprising:

a computer main body which outputs a video signal; and a display device having:

a displaying part which displays a picture based on the video signal, a power supply which supplies driving power corresponding to one of a normal mode and a power saving mode of the display device, a power saving mode selection part which allows a user to select the power saving mode from among a plurality of power saving modes presented to the user at the same time, and a micro controller which controls the power supply to supply the driving power to the display device according to the power saving mode selected through the power saving mode selection part, wherein the micro controller transmits a power saving mode signal corresponding to the power saving mode selected through the power saving mode selection part to the computer main body, so as to allow the computer main body to be in a power state of the selected power saving mode.

16. The computer system according to claim 15, wherein the micro controller controls the power supply to supply the driving power corresponding to the power saving mode based on whether horizontal and vertical synchronous signals of the video signal are output from the computer main body.

17. The computer system according to claim 16, wherein the power saving mode includes a standby mode, a suspend mode and a power-off mode.

18. A method of controlling a computer system comprising a computer main body and a display device having a power saving mode selection part which allows a user to select a power saving mode of the display device from among a plurality of power saving modes presented to the user at the same time, and a micro controller which transmits a power saving signal of the power saving mode selected through the power saving mode selection part to the display device and the computer main body, the method comprising:

receiving the power saving signal; and controlling the display device and the computer main body to be in the selected power saving mode, wherein the plurality of power saving modes includes a standby mode, a suspend mode and a power-off mode.

19. A computer readable medium with operating instructions for implementing a method of controlling a display device having a displaying part which displays an image output from a computer main body and a power saving mode selection part which allows a user to select a power saving mode of the display device from among a plurality of power saving modes presented to the user at the same time, performed by a computer, the method comprising:

obtaining the power saving mode through the power saving mode selection part; and controlling the display device to be in the power saving mode, through a micro controller, according to the power saving mode selected through the power saving mode selection part, wherein the plurality of power saving modes includes a standby mode, a suspend mode and a power-off mode, and wherein the micro controller transmits a power saving mode signal corresponding to the selected power saving mode to the computer main body, so as to cause the computer main body to be in the selected power saving mode.

20. The computer readable medium according to claim 19, further comprising:

checking whether the computer main body outputs a horizontal synchronous signal and a vertical synchronous signal; and allowing the display device to be in the power saving mode corresponding to whether each of the horizontal synchronous signal and the vertical synchronous signal is output.

21. The computer readable medium according to claim 20, further comprising allowing the computer main body to be in the selected power saving mode by transmitting a power saving mode signal corresponding to the power saving mode selected through the power saving mode selection part to the computer main body.

* * * * *